US006732418B2

(12) United States Patent
Rada

(10) Patent No.: US 6,732,418 B2
(45) Date of Patent: May 11, 2004

(54) METHOD OF CONSTRUCTING A RAIL TRACK ON A CONCRETE SLAB AND A TEMPORARY TIE PLATE FOR USE IN THE METHOD

(75) Inventor: Nicolas Rada, Neuilly sur Seine (FR)

(73) Assignee: Alstom, Paris (FR)

( * ) Notice: Subject to any disclaimer, the term of this patent is extended or adjusted under 35 U.S.C. 154(b) by 70 days.

(21) Appl. No.: 10/278,980

(22) Filed: Oct. 24, 2002

(65) Prior Publication Data

US 2003/0084558 A1 May 8, 2003

(30) Foreign Application Priority Data

Nov. 7, 2001 (FR) ..... 01 14401

(51) Int. Cl.[7] ..... B23P 11/00

(52) U.S. Cl. ..... 29/428; 29/464; 238/29; 238/27; 238/2; 264/33; 264/228; 264/161

(58) Field of Search ..... 29/428, 436, 464, 29/466; 238/29, 27, 2, 5, 7, 25; 264/33, 228, 161; 249/2, 141, 97

(56) References Cited

U.S. PATENT DOCUMENTS 4,255,104 A * 3/1981 Stinton ..... 425/111
4,616,395 A * 10/1986 Farese et al. ..... 29/460
4,730,805 A * 3/1988 Yokota et al. ..... 249/113
5,160,084 A * 11/1992 Owen et al. ..... 238/310
6,488,215 B2 * 12/2002 Mohr ..... 238/2

FOREIGN PATENT DOCUMENTS

DE 28 30 137 A 1/1980

* cited by examiner

*Primary Examiner*—David P. Bryant
*Assistant Examiner*—Stephen Kenny
(74) *Attorney, Agent, or Firm*—Sughrue Mion, PLLC

(57) ABSTRACT

A method of constructing a rail track on a concrete slab, in which method the concrete slab is poured around anchor members for fixing tie plates supporting rails of the rail track, includes the following steps: suspending temporary tie plates at the location where the tie plates supporting the rail track are to be placed, the temporary tie plates supporting anchor members to be partly embedded in the concrete and including vents for evacuating air trapped under the bottom face of the temporary tie plate when pouring the concrete slab, pouring a concrete slab up to the height of the temporary tie plates, removing the temporary tie plates after the concrete slab has dried, and placing the tie plates supporting the rails accurately in their final position and fixing the tie plates to the anchor members.

9 Claims, 4 Drawing Sheets

METHOD OF CONSTRUCTING A RAIL TRACK ON A CONCRETE SLAB AND A TEMPORARY TIE PLATE FOR USE IN THE METHOD

BACKGROUND OF THE INVENTION

1. Field of the Invention

The invention relates to a method of constructing a rail track and in particular to a method of constructing a rail track on a concrete slab in which the concrete slab is poured around anchor members for fixing tie plates supporting the rails of the rail track. The invention also relates to a temporary tie plate used in the method according to the invention.

2. Description of the Prior Art

Laying a rail track for metros or trams on a concrete slab by placing prefabricated rails directly onto tie plates at the location where the track is to be laid, the rails being suspended in their final position by means of a gantry with the tie plates fixed to the rails by attachments, is currently known in the art. A concrete slab is then poured under the rails, up to the height of the tie plates, which support anchor members consisting of threaded rods passing through the tie plates and having a bottom part embedded in the concrete slab. When the concrete has set, the tie plates are permanently immobilized on the concrete slab by tightening nuts onto the threaded rods, the nuts bearing on the top face of the tie plates.

The above kind of method of constructing a rail track nevertheless has the disadvantage of being subject to problems with the formation of air bubbles under the tie plates when pouring the concrete, which prevents the formation of a properly flat concrete bearing surface under the tie plates. Accordingly, when the nuts are tightened onto the threaded rods to immobilize the tie plates after the concrete has set, it is common for the tie plate to move because of the imperfect bearing surface. It is then necessary to demount the tie plate and make good the bearing surface manually to enable correct positioning of the tie plate. This reworking of defective bearing surfaces is time-consuming and costly and considerably slows down laying the rail track.

Also, one object of the present invention is to propose a simple and economic method of producing a rail track that forms without major defects bearing surfaces on which the tie plates supporting the rails rest.

SUMMARY OF THE INVENTION

To this end, the invention provides a method of constructing a rail track on a concrete slab, in which method said concrete slab is poured around anchor members for fixing tie plates supporting rails of the rail track, which method includes the following steps:

- suspending temporary tie plates at the location where the tie plates supporting the rail track are to be placed, the temporary tie plates supporting anchor members adapted to be partly embedded in the concrete and including vents for evacuating air trapped under the bottom face of the temporary tie plate when pouring the concrete slab,
- pouring a concrete slab up to the height of the temporary tie plates,
- removing the temporary tie plates after the concrete slab has set, and
- placing the tie plates supporting the rails accurately in their final position and fixing the tie plates to the anchor members.

According to another feature of the invention the rails are suspended above the location where the concrete slab is to be poured by means of a gantry, the rails having permanent tie plates premounted on them, the temporary tie plates being placed under the tie plates and then moved into the required position by means of the gantry.

According to a further feature of the invention, after the step of removing the temporary tie plates and before the step of placing the permanent tie plates, any flashing formed on the surface of the concrete slab by concrete rising up through the vents is scraped off.

The invention also provides a temporary tie plate for use in the method according of constructing a rail track previously described, which temporary tie plate includes a body whose bottom face, with which the concrete comes into contact when pouring the concrete slab, includes vents.

In particular embodiments the temporary tie plate according to the invention can have any of the following features alone or any technically feasible combination:

- the body of the temporary tie plate comprises a plate with multiple through-holes;
- the periphery of the plate includes a step having a top edge inclined relative to the plane of the bottom face of the plate to provide a reference when forming the concrete surface of the track slab when the latter must incorporate a slope for drainage;
- the body of the temporary tie plate includes openings with a larger diameter than the vents to enable anchor means to pass through them.

Objects, aspects and advantages of the present invention will be understood better from the description of one particular and non-limiting embodiment of the invention given hereinafter and with reference to the accompanying drawings.

DETAILED DESCRIPTION OF THE PREFERRED EMBODIMENT

To clarify the drawings, only components necessary for understanding the invention are shown. The same components carry the same reference numbers from one figure to the other.

Figure 1:
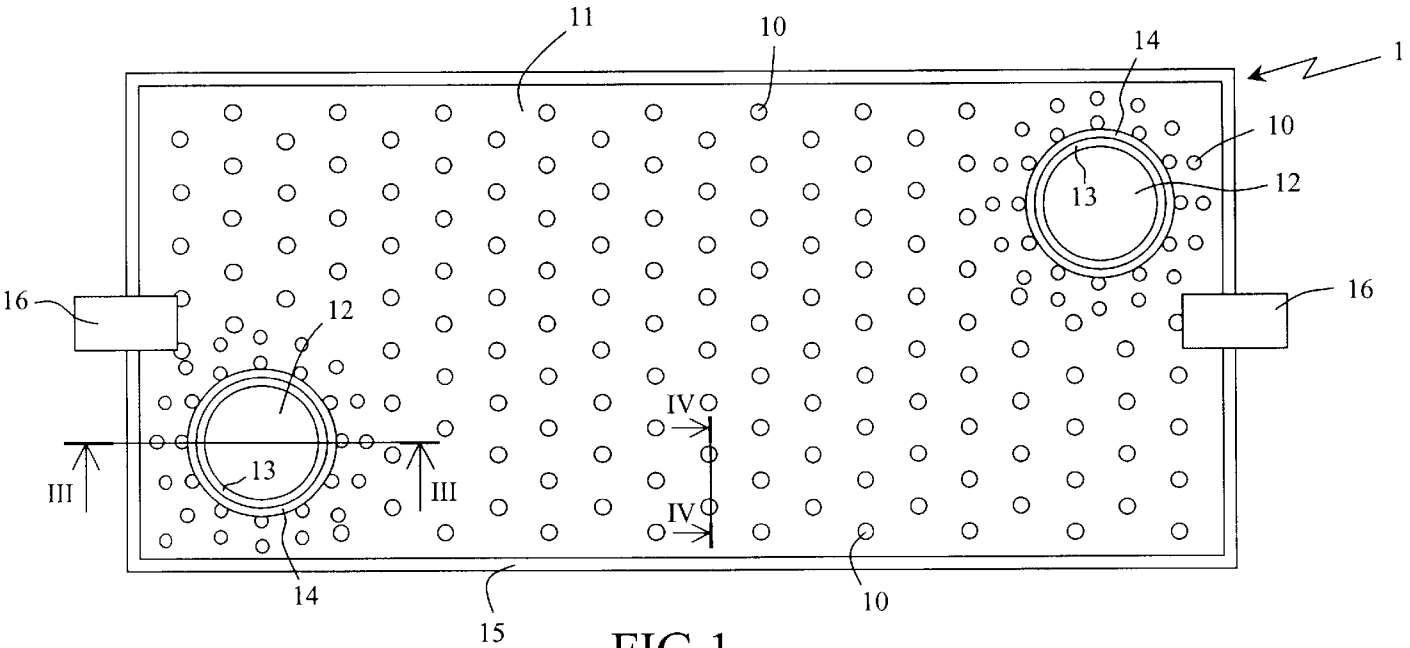
FIG. 1 is a top view of one particular embodiment of a temporary tie plate according to the invention.
Figure 2:
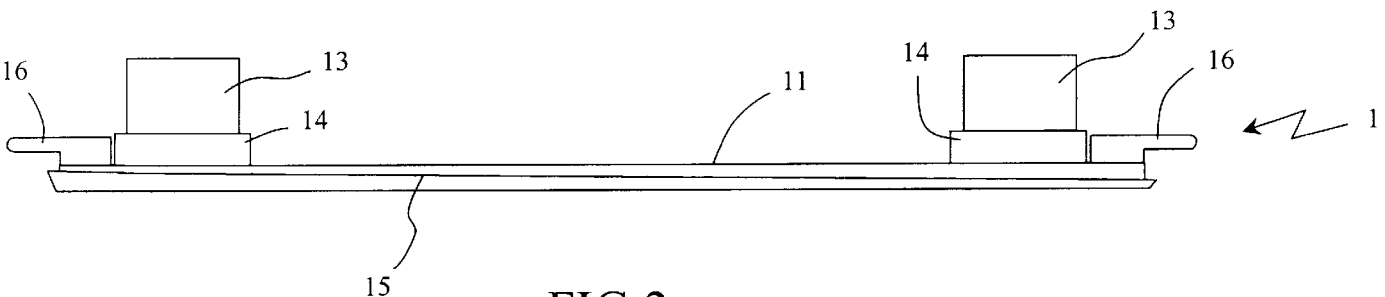
FIG. 2 is a side view of the temporary tie plate shown in FIG. 1.
Figure 4:
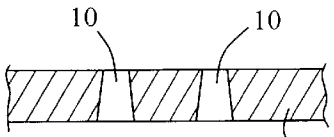
FIG. 4 is a detail view showing a section of the temporary tie plate taken along the line IV—IV in FIG. 1.

FIGS. 1 and 2 show one particular embodiment of a temporary tie plate 1 according to the invention. As shown in those figures, the temporary tie plate 1 includes a body 11 formed by a rectangular metal plate having multiple vents 10 opening onto the top and bottom faces of the metal plate 11. The vents 10 take the form of holes, some of which have a slightly convergent circular section, as shown in more detail in FIG. 4, the diameter of these holes 10 being 7 mm at the bottom face of the plate 11 and 5 mm at the top face, for example.

The plate 11 also includes two openings 12 at diagonally opposite ends of the plate 11. The openings 12 receive guide pins 13 having an outside diameter matching the diameter of the opening 12 and an internal bore adapted to receive a closely fitting threaded rod 4, not shown in FIGS. 1 and 2.

Figure 3:
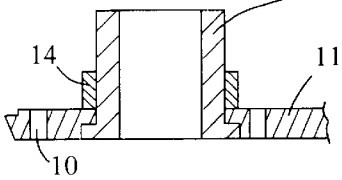
FIG. 3 is a detail view showing a section of the temporary tie plate taken along the line III—III in FIG. 1.

As shown in FIG. 3, the guide bushes 13 have in their bottom part a shoulder which is inserted into a matching cavity on the bottom face of the plate 11 when the bushes 13 are inserted into the openings 12 through the bottom face of the temporary tie plate 1.

Spreaders 14 comprising cylindrical washers are disposed around the guide bushes 13 on the top face of the plate 11 and include an internal bore slightly larger than the outside diameter of the guide bushes 13.

The outside periphery of the plate 11 has a step 15 whose edge is beveled in the direction of the bottom face of the plate 11, the top edge of the step 15 on the longitudinal side of the plate 11 being inclined relative to the plane of the bottom face of the plate 11.

The temporary tie plate 1 also includes extractor handles 16 to facilitate holding it.

Figure 7:
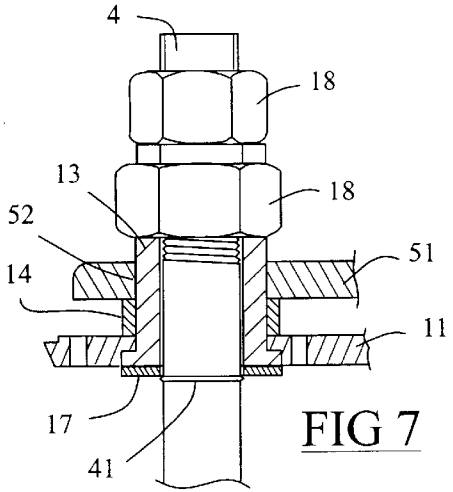
FIG. 7 is a detail view in section similar to that of FIG. 3 of the means for assembling the temporary tie plate to the permanent tie plate intended to support the rail.
Figure 6:
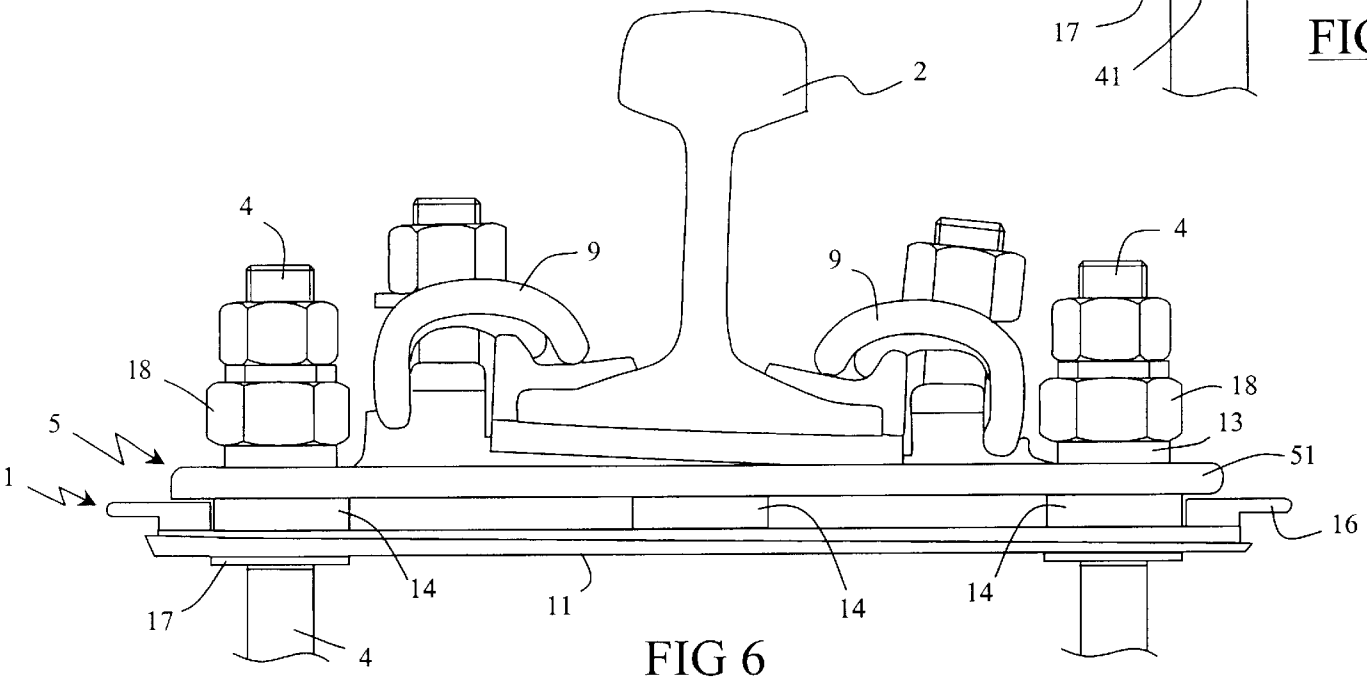
FIG. 6 is an enlarged view of one of the rails shown in FIG. 5, equipped with a temporary tie plate conforming to one particular embodiment of the construction method according to the invention.

The use of the temporary tie plate 1 previously described and the construction method in accordance with the invention are described next with reference to FIGS. 5 to 7.

Figure 5:
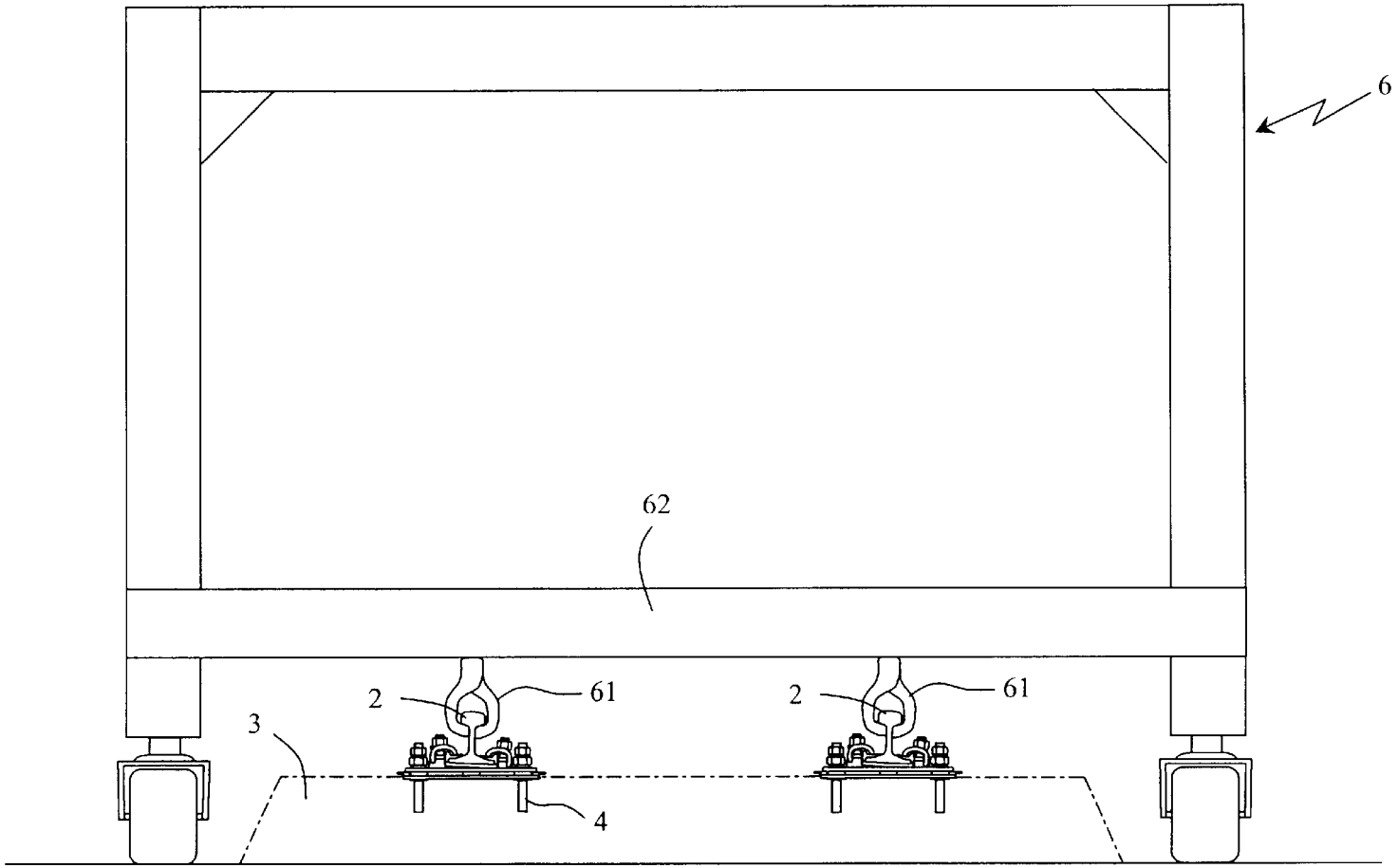
FIG. 5 is an overall view of a system for implementing a construction method according to the invention.

As shown in FIG. 5, a gantry 6 suspends two rails 2 over the place where a concrete slab 3 is to be poured. The two rails 2 are suspended by means of damps 61 connected to a motorized bean 162 which slides vertically on the gantry 6 to move the two rails 2 precisely to the required location. As can be seen in more detail in FIGS. 6, 7 and 8, the two rails 2 are connected to tie plates 5 by attachments 9, the tie plates 5 conventionally including a base 51 comprising a substantially solid metal plate adapted to bear on the concrete slab 3 through the intermediary of a baseplate 20, shown in FIG. 8, made of a resilient and advantageously electrically insulating material.

A temporary tie plate 1 like that previously described is placed under each of the tie plates 5 so that the guide bushes 13 supported by the temporary tie plate 1 engage in matching openings 52 in the base 51, the bottom face of the base 51 bearing on the top of the spreaders 14 supported by the temporary tie plate 1, so that a space is Conned between the bottom face of the base 51, and the top face of the plate 11 of the temporary tie plate 1. The temporary tie plate 1 is held in this position under the tie plate 5 by the members for anchoring the tie plate 5 to the concrete slab 3, which comprise threaded rods 4 inserted into the guide bushes 13 and receiving in their upper part locking nuts 18, the threaded rods 4 having a local constriction 41 on which rests a washer 17 bearing on the bottom face of the guide bushes 13. The threaded rods 4 disposed in this way have a portion projecting a great distance from the bottom face of the temporary tie plates 1 and are intended to be embedded in the concrete.

Before pouring the concrete slab 3, the bottom face of the temporary tie plates 1 is coated with a shuttering-release oil and the beam 62 of the gantry 6 is shifted to move the bottom face of the temporary tie plates 1 to the intended location of the bearing surfaces of the tie plates 5 for supporting the rails 2 of the track to be constructed.

A concrete slab 3, shown in chain-dotted outline in FIG. 5, is then poured up to the height of the temporary tie plates 1 and around the portion of the threaded rods 4 projecting from the bottom of the plate 11. The top surface of the concrete 3 is then smoothed so that the surface of the concrete 3 follows the slope of the step 15 at the edge of the temporary tie plate 1, the latter indicating the required inclination of the concrete slab 3 relative to the horizontal for correct evacuation of surface water.

After a drying time to enable the concrete slab 3 to set, the nuts 18 on the threaded rods 4 are removed and the rails 2 premounted on their tie plates 5 are raised by means of the gantry 6. The temporary tie plates 1 accompanied by the guide bushes 13 and the spreaders 14 are then removed, the handles 16 facilitating the removal of the temporary tie plates 1.

Any flashing formed on the surface of the concrete slab 3 by concrete rising up through the vents 10 in the temporary tie plates 1 are then easily eliminated by simply scraping and then blowing off the surface.

Figure 8:
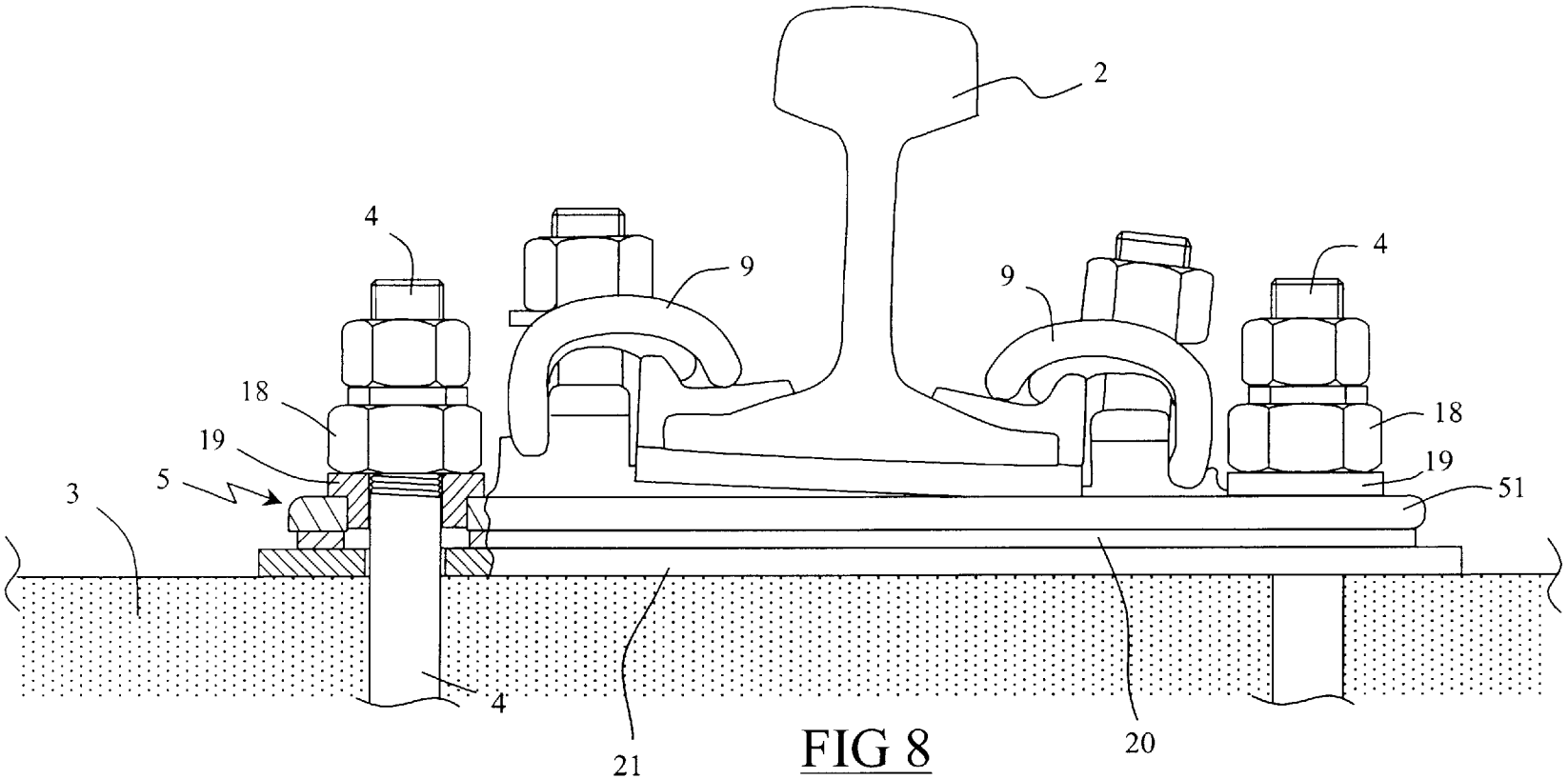
FIG. 8 is a partly sectioned side view of the permanent tie plate after it has been mounted on the concrete slab.

Electrically insulative spacers 19 shown in FIG. 8 are then placed inside the openings 52 of the tie plates 5, the insulative spacers 19 having a body with a cylindrical part inserted in the openings 52 whose inside and outside diameters are identical to the inside and outer diameters of the guide bushes 13, i.e. they are respectively a close fit to the diameter of the openings 52 and the threaded rods 4. The spacers 19 also have a flange in their top part on which the clamping nuts 18 bear, with an optional spring, not shown in the figures, inserted between the nut and the flange of the spacer 19, the height of the spacer 19 being such that it does not project beyond the bottom face of the tie plate 5 when it is inserted in the opening 52.

The rails 2 premounted on their tie plates 5 are then lowered again, after inserting the resilient material baseplate 20 under the bottom face of the base 51, the baseplate 20 having holes in line with the threaded rods 4. An additional baseplate 21, which need only be electrically insulative, is advantageously placed under the previously mentioned baseplate 20, the combination being brought into contact with the concrete slab 3 by passing the threaded rods 4 projecting from the concrete slab 3 through the baseplates 20, 21 and the bores of the insulative spacers 19 disposed in the openings 52 of the tie plates 5, as shown in FIG. 8. Because of the presence during this operation of the insulative spacers 19, which have radial dimensions similar to those of the guide bushes 13, the tie plates 5 are placed at their final position automatically and accurately.

The tie plates 5 are then immobilized in the conventional way by means of nuts 18 screwed onto the threaded rods 4, the latter bearing on the top face of the tie plate 5 through the intermediary of the flange of the insulative spacer 19.

The above kind of construction method, using temporary tie plates in accordance with the invention, produces a homogeneous bearing surface for the tie plates easily and quickly, avoids any movement of the tie plates during tightening of the nuts, and ensures that the position of the tie plates is stable in time. Pouring the concrete slab has the advantage that it is carried out with no risk of air bubbles appearing under the temporary tie plates because of the numerous vents in the temporary tie plates, which are not obstructed by the tie plate because of the spreaders.

Of course, the invention is in no way limited to the embodiment described and shown, which has been described and shown merely by way of example, and can be modified without departing from the scope of the protection afforded to the invention, in particular with regard to the composition of the various components or by substituting technical equivalents.

What is claimed is:

1. A method of constructing a rail track on a concrete slab, in which method said concrete slab is poured around anchor members for fixing tie plates supporting rails of said rail track, which method includes the following steps:

suspending temporary tie plates at the location where said tie plates supporting said rail track are to be placed, said temporary tie plates supporting anchor members adapted to be partly embedded in said concrete and including vents for evacuating air trapped under the bottom face of said temporary tie plate when pouring said concrete slab, pouring a concrete slab up to the height of said temporary tie plates, removing said temporary tie plates after said concrete slab has dried, and placing said tie plates supporting said rails accurately in their final position and fixing said tie plates to said anchor members.

2. The method claimed in claim 1 of constructing a rail track, wherein said rails are suspended above the location where said concrete slab is to be poured by means of a gantry, said rails having tie plates premounted on said rails, and said temporary tie plates are placed under said tie plates and are then moved into the required position by means of said gantry.

3. The method claimed in claim 1 of constructing a rail track, wherein after said step of removing said temporary tie plates and before said step of placing said tie plates, any flashing formed on the surface of said concrete slab by concrete rising up through said vents is scraped off.

4. A temporary tie plate for use in a method as claimed in claim 1 of constructing a rail track, which temporary tie plate includes a body whose bottom face, with which said concrete comes into contact when pouring said concrete slab, includes vents, wherein said body consists of a plate with multiple through-holes, said plate including extractor handles.

5. The temporary tie plate claimed in claim 4, wherein the periphery of said plate includes a step having a top edge inclined relative to the plane of the bottom face of said plate.

6. The temporary tie plate claimed in claim 4, wherein said body includes openings with a larger diameter than said vents to enable anchor means to pass through them.

7. The method of claim 1, wherein prior to pouring the concrete the temporary tie plate is coated with a shuttering-release oil on the face of the temporary tie plate which comes in contact with the cement that is to be poured.

8. The temporary tie plate of claim 4, wherein said inclined top edge provides a template for a slope of the poured concrete such that surface water is evacuated away from the tie plates in their final position.

9. The method of claim 1, wherein the tie plates are separated from the temporary tie plates by spreaders during pouring and curing of the concrete.

* * * * *